US010934776B2

(12) United States Patent
Zhou et al.

(10) Patent No.: US 10,934,776 B2
(45) Date of Patent: Mar. 2, 2021

(54) CLOSURE COVER AND EXTENSION LADDER

(71) Applicants: Minqing Zhou, Zhejiang (CN); Jinchai Huang, Zhejiang (CN)

(72) Inventors: Minqing Zhou, Zhejiang (CN); Jinchai Huang, Zhejiang (CN)

( * ) Notice: Subject to any disclaimer, the term of this patent is extended or adjusted under 35 U.S.C. 154(b) by 195 days.

(21) Appl. No.: 16/303,676

(22) PCT Filed: Jul. 3, 2017

(86) PCT No.: PCT/CN2017/091530

§ 371 (c)(1),
(2) Date: Nov. 21, 2018

(87) PCT Pub. No.: WO2018/192095

PCT Pub. Date: Oct. 25, 2018

(65) Prior Publication Data

US 2020/0173232 A1 Jun. 4, 2020

(30) Foreign Application Priority Data

Apr. 20, 2017 (CN) ..... 201710260165.6

(51) Int. Cl.

| | |
|---|---|
| ***E06C 1/12*** | (2006.01) |
| ***E06C 7/08*** | (2006.01) |
| *E06C 1/18* | (2006.01) |
| *E06C 1/22* | (2006.01) |
| *E06C 1/383* | (2006.01) |
| *E06C 7/00* | (2006.01) |

(52) U.S. Cl.
CPC ..... *E06C 1/125* (2013.01); *E06C 7/08* (2013.01); *E06C 1/18* (2013.01); *E06C 1/22* (2013.01); *E06C 1/383* (2013.01); *E06C 7/003* (2013.01)

(58) Field of Classification Search
CPC ..... E06C 1/125; E06C 1/08; E06C 1/12
See application file for complete search history.

(56) References Cited

U.S. PATENT DOCUMENTS 5,529,154 A * 6/1996 Tanaka ..... F16F 9/3484 188/282.6
5,937,976 A * 8/1999 Grundei ..... F16F 9/3485 188/282.6

(Continued)

FOREIGN PATENT DOCUMENTS

CN 201170058 Y 12/2008
CN 203334945 U 12/2013

(Continued)

*Primary Examiner* — Colleen M Chavchavadze
(74) *Attorney, Agent, or Firm* — Berggren LLP

(57) ABSTRACT

A closure cover and an extension ladder are provided. The closure cover includes an upper closure plate, a lower closure plate, and two airtight sheets, the upper closure plate and the lower closure plate are fixedly connected by a connector, the upper closure plate and the lower closure plate are each provided with ventilation holes, the airtight sheets are fixed to a surface of the upper closure plate facing away from the lower closure plate and a surface of the lower closure plate facing away from the upper closure plate, respectively, and the airtight sheets are capable of controlling the closing and opening of the ventilation holes.

6 Claims, 3 Drawing Sheets

(56) References Cited

U.S. PATENT DOCUMENTS

| | | | | |
|---|---|---|---|---|
| 6,336,536 | B1 * | 1/2002 | Fenn | F16F 9/3485 188/282.6 |
| 6,644,445 | B2 * | 11/2003 | Dodge | F16F 9/3484 188/282.6 |
| 6,672,436 | B1 * | 1/2004 | Keil | F16F 9/3214 188/322.14 |
| 6,851,528 | B2 * | 2/2005 | Lemieux | F16F 9/44 188/266.6 |
| 6,959,797 | B2 * | 11/2005 | Mintgen | F16F 9/0218 188/282.5 |
| 7,316,293 | B2 * | 1/2008 | Yao | E06C 1/125 182/195 |
| 8,016,088 | B2 * | 9/2011 | Morita | F16F 9/3481 188/282.6 |
| 8,235,188 | B2 * | 8/2012 | Kais | F16F 9/3481 188/322.15 |
| 8,869,939 | B2 * | 10/2014 | Kuo | E06C 7/003 182/195 |
| 9,416,591 | B2 * | 8/2016 | Kieffer | E06C 1/32 |
| 9,777,790 | B2 * | 10/2017 | Mizuno | F16F 9/3484 |
| 10,053,912 | B2 * | 8/2018 | Kieffer | E06C 1/125 |
| 10,167,918 | B2 * | 1/2019 | Miwa | F16F 9/3484 |
| 10,435,946 | B2 * | 10/2019 | Nielsen | E06C 1/125 |
| 2006/0283664 | A1 * | 12/2006 | Yao | E06C 7/06 182/156 |
| 2006/0283665 | A1 * | 12/2006 | Yao | E06C 1/18 182/195 |
| 2007/0267252 | A1 | 11/2007 | Yao | |
| 2019/0360269 | A1 * | 11/2019 | Hooiveld | E06C 7/082 |

FOREIGN PATENT DOCUMENTS

| | | | | | |
|---|---|---|---|---|---|
| CN | 204436248 | U | | 7/2015 | |
| CN | 205400572 | U | | 7/2016 | |
| CN | 205638198 | U | | 10/2016 | |
| CN | 205840753 | U | | 12/2016 | |
| CN | 205859033 | U | | 1/2017 | |
| CN | 206111921 | U | | 4/2017 | |
| DE | 202015101425 | U1 | * | 4/2015 | E06C 1/125 |
| GB | 2305955 | A | * | 4/1997 | E06C 1/125 |
| GB | 2436584 | B | * | 8/2011 | E06C 1/125 |
| GB | 2536297 | A | * | 9/2016 | E06C 1/125 |
| JP | 0893371 | A | | 4/1996 | |
| WO | WO-2018129982 | A1 | * | 7/2018 | E06C 1/125 |

* cited by examiner

CLOSURE COVER AND EXTENSION LADDER

CROSS-REFERENCE TO RELATED APPLICATIONS

This application claims priority to Chinese Patent Application No. 201710260165.6, filed with the Chinese Patent Office on Apr. 20, 2017, entitled "Closure Cover and Extension Ladder", which is incorporated herein by reference in its entirety.

TECHNICAL FIELD

The present disclosure relates to the technical field of daily tools, and in particular to a closure cover and an extension ladder.

BACKGROUND ART

An extension ladder is a ladder allowing a person to work at a high place that can be stretched and extended when in use, and can be folded, shortened for storing when not in use. The commonly used extension ladder comprises ladder rails, consisting of a plurality of segmental rails (rail segments), and transverse ladder steps (rungs), the plurality of segmental rails are gradually reduced in size, the adjacent segmental rails are extendably sleeved and fixed to each other, and each of the segmental rails is fixed with a transverse ladder step. When not in use, the segmental rails are all retracted into an inner cavity of the segmental rail with the largest size, and the transverse ladder steps are brought into contact with each other, and at this time, the extension ladder has the minimum overall size and can be stored conveniently. When in use, the extension ladder is stretched so that a distance between each two adjacent transverse ladder steps is increased to a set position, and then the positional relation between the adjacent segmental rails is fixed by a locking device so that the relative positions of the adjacent transverse ladder steps remain unchanged.

However, in the prior art, when the locking device releases the relative fixings between the adjacent segmental rails, under action of the gravity of the segmental rails and the transverse ladder steps, the transverse ladder steps are folded at a gradually increasing speed due to a small friction force between the adjacent segmental rails. At this time, if the user's hands hold the ladder at an improper position, for example, at a position just between two transverse ladder steps, the gravity of the upper segmental rails and transverse ladder steps descending at a very fast speed is likely to cause the user's fingers to be pinched and injured, which brings a great safety hazard.

SUMMARY

An object of the present disclosure is to provide a closure cover and an extension ladder to alleviate the technical problem that the extension ladder in the prior art is likely to cause a pinching injury or a crush injury to the user due to an excessively fast descending speed during retraction.

The present disclosure provides a closure cover comprising an upper closure plate, a lower closure plate, and two airtight sheets (air-closing pieces), wherein the upper closure plate and the lower closure plate are fixedly connected by a connector, the upper closure plate and the lower closure plate are each provided thereon with ventilation holes, one of the two airtight sheets is fixed to a surface of the upper closure plate facing away from the lower closure plate, with the other one airtight sheet fixed to a surface of the lower closure plate facing away from the upper closure plate, and each of the airtight sheets is capable of controlling respectively closing and opening of the ventilation holes.

Further, screws and pressure (pressing) plates are further included, each of the airtight sheets is a circular elastic sheet, a connecting hole is provided at the center of each of the airtight sheets, a screw hole is provided at the center of each of the upper closure plate and the lower closure plate, and each of the screws sequentially passes through the respective pressure plate and the connecting hole and is screwed tight and fixed into the screw hole.

Further, screw nuts and pressure plates are further included, each of the airtight sheets is a circular elastic sheet, a connecting hole is provided at the center of each of the airtight sheets, a stud is disposed at a center of the surface of the upper closure plate away from the lower closure plate and at a center of the surface of the lower closure plate away from the upper closure plate respectively, and each of the studs sequentially passes through the connecting hole and the respective pressure plate and is screwed tight and fixed with the screw nut.

Further, each of the upper closure plate and the lower closure plate is provided with an air outlet hole for slow-descending, wherein each of the air outlet holes for slow-descending is remote from the airtight sheets.

Further, sealing rings are further included, a side edge of each of the upper closure plate and the lower closure plate is provided with a sealing ring groove, and the sealing rings are fixed in the sealing ring grooves, respectively.

Further, the connector is a cylindrical supporting column having two ends fixed at central positions of the upper closure plate and the lower closure plate, respectively; and the supporting column, the upper closure plate, and the lower closure plate are formed integrally.

The present disclosure further provides an extension ladder comprising two ladder rails and a plurality of transverse ladder steps;

wherein each of the ladder rails comprises a plurality of segmental rails and a plurality of closure covers described above; and the segmental rails on the two ladder rails are in one-to-one correspondence, and two ends of each of the transverse ladder steps are respectively fixed to one ends of the two corresponding segmental rails which are in one-to-one correspondence, with the one ends fixed to the upper closure plates.

Further, an air-bleed hole is provided at an intermediate position of each of the segmental rails.

Further, at least one elastic fastener is disposed on a surface of each of the lower closure plate facing the upper closure plates respectively, at least one snapping groove is disposed at a corresponding position of an inner wall of each of the segmental rails, and the elastic fasteners can be snap-fitted in the snapping grooves.

Further, fixing pins are further included, wherein the connectors and the segmental rails are provided with pin holes, and each of the upper closure plates is fixedly connected with each of the segmental rails by passing the fixing pins through the two pin holes, respectively.

Compared with the prior art, the closure cover and the extension ladder according to the present disclosure have the following advantageous effects:

The closure cover according to the present disclosure comprises an upper closure plate, a lower closure plate, and two airtight sheets. Each of the airtight sheets have an area capable of ensuring sealing and blocking the ventilation holes on the upper closure plate and the lower closure plate when the airtight sheets are attached and fixed to the upper closure plate and the lower closure plate. The connector allows the upper closure plate and the lower closure plate to be positioned fixedly relative to each other while forming a cavity therebetween. A slow descending function of the extension ladder is accomplished by fixing this closure cover between two adjacent segmental rails. Specifically, the upper closure plate is sleeved and fixed to one end of one segmental rail, the lower closure plate is sleeved in a cavity of the other segmental rail, and a sealing member is disposed both between a side edge of the upper closure plate and an inner wall of the segmental rail and between a side edge of the lower closure plate and an inner wall of the other segmental rail, and the segmental rail to which the upper closure plate is fixed is extendably sleeved in the inner cavity of the segmental rail in which the lower closure plate is sleeved.

When the segmental rails are retracted relative to each other, a cavity between the upper closure plate of one closure cover and the lower closure plate of another adjacent closure cover is pressed, and an internal pressure is increased, such that the airtight sheets are closely attached to the upper closure plate and the lower closure plate under the pressure from the internal gas air (gas), the ventilation holes are in a closed state, the air in the cavity cannot be discharged in time, and the internal pressure is further increased as the adjacent segmental rail is further retracted, and thus an upward jacking force is given to the upper segmental rail pressing downward, so that the portion of the upper segmental rail is decreased in speed, thereby avoiding an accident such as a pinching injury or a crush injury to the user due to an excessively fast speed.

Furthermore, since the closure cover is fixed between adjacent segmental rails, the cavity between the upper closure plate and the lower closure plate communicates with the outside through a gap between the adjacent segmental rails, and is at standard atmospheric pressure. When the segmental rails are stretched relative to each other, the cavity between the upper closure plate of one closure cover and the lower closure plate of another adjacent closure cover is at an underpressure, and the cavity between the upper closure plate and the lower closure plate gives the airtight sheets a force away from the upper closure plate or the lower closure plate, so that the airtight sheets are deformed, and the ventilation holes are exposed, and thus the pressure in the cavity between the upper closure plate of one closure cover and the lower closure plate of another adjacent closure cover is quickly restored to standard atmospheric pressure, thereby ensuring easy and effortless stretching between the segmental rails.

The technical advantages of the extension ladder according to the present disclosure are the same as those of the closure cover described above, and therefore are not described repeatedly herein.

BRIEF DESCRIPTION OF DRAWINGS

For illustrating technical solutions in specific embodiments of the present disclosure or in the prior art more clearly, drawings required for use in the description of the specific embodiments or the prior art will be introduced briefly below. It is apparent that the drawings in the following description are merely illustrative of some embodiments of the present disclosure. It would be appreciated by those of ordinary skill in the art that other relevant drawings could also be obtained from these drawings without any inventive effort.

Figure 1:
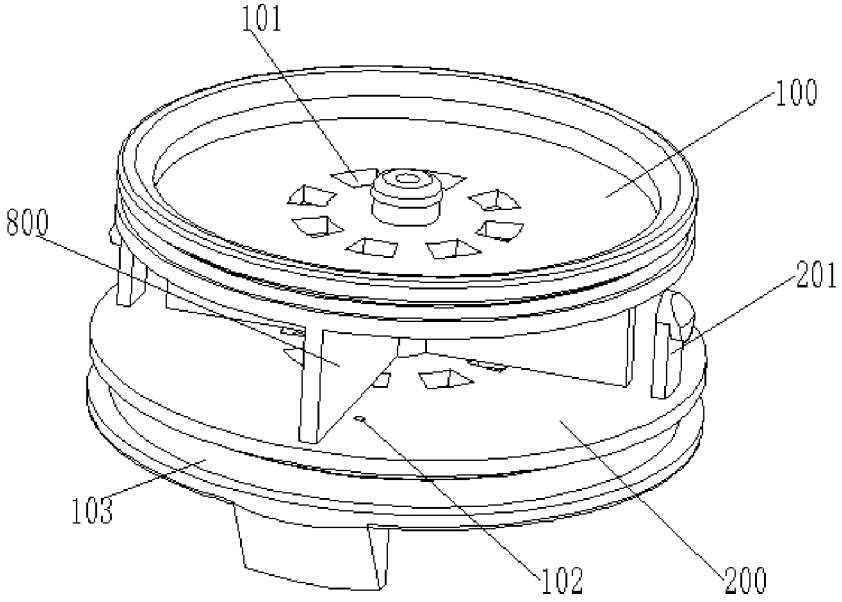
FIG. 1 is a structural schematic view of a closure cover according to an embodiment of the present disclosure.

Reference Numerals: 100—upper closure plate; 200—lower closure plate; 300—airtight sheet; 400—pressure plate; 500—screw; 600—segmental rail; 700—sealing ring; 800—connector; 101—ventilation hole; 102—air outlet hole for slow—descending; 103—sealing ring groove; 201—elastic fastener; 601—air-bleed hole; 602—snapping groove.

DETAILED DESCRIPTION OF EMBODIMENTS

The technical solutions of the present disclosure will be described clearly and completely below with reference to the accompanying drawings. It is apparent that the embodiments to be described are some, but not all of the embodiments of the present disclosure. All the other embodiments obtained by those of ordinary skill in the art in light of the embodiments of the present disclosure without inventive efforts should fall within the scope of the present disclosure as claimed.

In the description of the present disclosure, it should be noted that orientation or positional relations indicated by the terms such as "center", "up", "down", "left", "right", "vertical", "horizontal", "inside", and "outside" are the orientation or positional relations shown based on the drawings, and these terms are intended only to facilitate the description of the present disclosure and simplify the description, but not intended to indicate or imply that the referred devices or elements must be in a particular orientation or constructed or operated in the particular orientation, and therefore should not be construed as limiting the present disclosure. In addition, the terms "first", "second", and "third" are used for descriptive purpose only, and should not be understood as an indication or implication of relative importance.

In the description of the present disclosure, it should be noted that the terms "mounted", "coupled", and "connected" should be understood broadly unless otherwise expressly specified or defined. For example, a connection may be a fixed connection or a detachable connection or an integral connection, may be a mechanical connection or an electric connection, or may be a direct coupling or an indirect coupling via an intermediate medium or internal communication between two elements. The specific meanings of the above-mentioned terms in the present disclosure could be understood by those of ordinary skill in the art according to specific situations.

Figure 2:
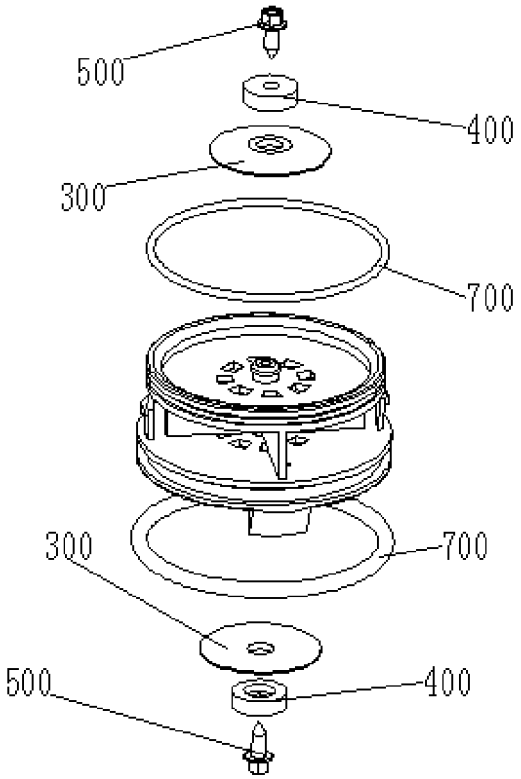
FIG. 2 is an exploded structural schematic view of a closure cover according to an embodiment of the present disclosure.
Figure 3:
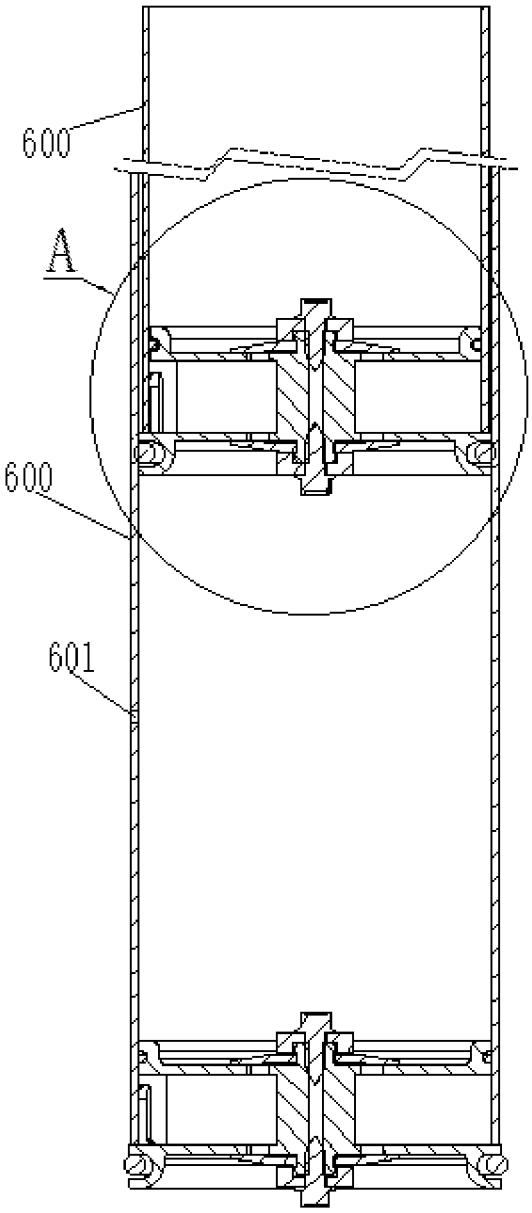
FIG. 3 is a half-sectional view of an extension ladder according to an embodiment of the present disclosure.
Figure 4:
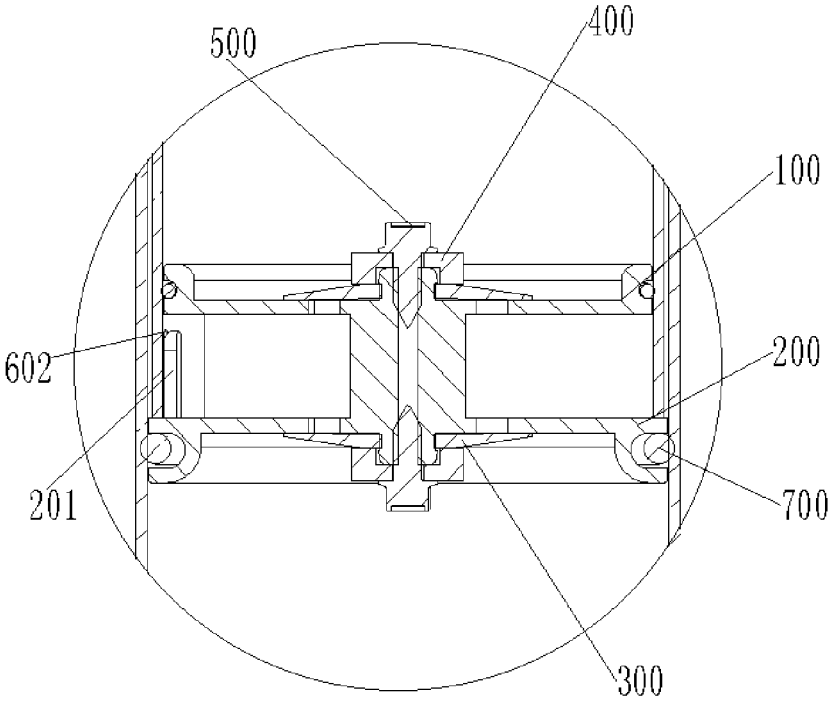
FIG. 4 is a structural schematic view of A in FIG. 3.

FIG. 1 is a structural schematic view of a closure cover according to an embodiment of the present disclosure; FIG. 2 is an exploded structural schematic view of a closure cover according to an embodiment of the present disclosure; FIG. 3 is a half-sectional view of an extension ladder according to an embodiment of the present disclosure; and FIG. 4 is a structural schematic view of A in FIG. 3.

First Embodiment

As shown in FIG. 1 and FIG. 2, an embodiment of the present disclosure provides a closure cover comprising an upper closure plate 100, a lower closure plate 200, and two airtight sheets 300, wherein the upper closure plate 100 and the lower closure plate 200 are fixedly connected by a connector 800, the upper closure plate 100 and the lower closure plate 200 are each provided thereon with ventilation holes 101, one of the two airtight sheets 300 is fixed to a surface of the upper closure plate 100 facing away from the lower closure plate 200, with the other airtight sheet fixed to a surface of the lower closure plate 200 facing away from the upper closure plate 100, and each of the airtight sheets 300 is capable of controlling respectively the closing and opening of the ventilation holes 101.

The closure cover according to the embodiment of the present disclosure comprises an upper closure plate 100, a lower closure plate 200, and two airtight sheets 300. Each of the airtight sheets 300 has an area capable of ensuring sealing and blocking the ventilation holes 101 on the upper closure plate 100 and the lower closure plate 200 when the airtight sheets are attached and fixed to the upper closure plate 100 and the lower closure plate 200. The connector 800 allows the upper closure plate 100 and the lower closure plate 200 to be positioned fixedly relative to each other while forming a cavity therebetween. The slow descending function of an extension ladder is accomplished by fixing this closure cover between two adjacent segmental rails 600. Specifically, the upper closure plate 100 is sleeved and fixed to one end of one segmental rail 600, the lower closure plate 200 is sleeved in a cavity of the other segmental rail 600, and a sealing member is disposed both between a side edge of the upper closure plate 100 and an inner wall of the segmental rail 600 and between a side edge of the lower closure plate 200 and an inner wall of the other segmental rail 600, and the segmental rail 600 to which the upper closure plate 100 is fixed is extendably sleeved in the inner cavity of the segmental rail 600 in which the lower closure plate 200 is sleeved.

When the segmental rails 600 are retracted relative to each other, a cavity between the upper closure plate 100 of one closure cover and the lower closure plate 200 of another adjacent closure cover is pressed, and an internal pressure is increased, such that the airtight sheets 300 are closely attached to the upper closure plate 100 and the lower closure plate 200 under the pressure from the internal air, the ventilation holes 101 are in a closed state, the air in the cavity cannot be discharged in time, and the internal pressure is further increased as the adjacent segmental rail 600 is further retracted, and thus an upward jacking force is given to the upper segmental rail 600 pressing downward, so that the portion of the upper segmental rail 600 is decreased in speed, thereby avoiding an accident such as a pinching injury or a crush injury to the user due to an excessively fast speed.

Furthermore, since the closure cover is fixed between adjacent segmental rails 600, the cavity between the upper closure plate 100 and the lower closure plate 200 communicates with the outside through a gap between the adjacent segmental rails 600, and is at standard atmospheric pressure. When the segmental rails 600 are stretched relative to each other, the cavity between the upper closure plate 100 of one closure cover and the lower closure plate 200 of another adjacent closure cover is at an underpressure, and the cavity between the upper closure plate 100 and the lower closure plate 200 gives the airtight sheets 300 a force away from the upper closure plate 100 or the lower closure plate 200, so that the airtight sheets 300 are deformed, and the ventilation hole 101 are exposed, and thus the cavity between the upper closure plate 100 of one closure cover and the lower closure plate 200 of another adjacent closure cover is quickly restored to standard atmospheric pressure, thereby ensuring easy and effortless stretching between the segmental rails 600.

It is worth noting that a plurality of ventilation holes 101 are provided in the present embodiment, and are arranged on the upper closure plate 100 and the lower closure plate 200 in a ring shape around center points of the upper closure plate 100 and the lower closure plate 200.

In addition, in the present embodiment, the airtight sheets 300 are provided as circular elastic sheets made of metal. Specifically, each of the circular elastic sheets has a small thickness to ensure easy deformation under a force, and moreover, it has good elasticity so that it is disposed to be almost attached to (abutted against) the upper closure plate 100 and the lower closure plate 200 in a state where no force is applied, thereby ensuring the sealing effect by the airtight sheets 300 to the ventilation holes 101 and ensuring the easy and effortless stretching effect by its easy deformability during the stretching of the segmental rails 600.

Further, the central positions of the airtight sheets 300 and the central positions of the upper closure plate 100 and the lower closure plate 200 are fixed relative to each other to ensure that portions of the airtight sheets 300 at the positions of the respective ventilation holes 101 are in the same deformation state when forces of the same magnitude are applied thereto, so that the airtight sheets 300 have a stable deformation rule, and the service life of the airtight sheets 300 are increased.

Specifically, the fixing between the airtight sheets 300 and each of the upper closure plate 100 and the lower closure plate 200 are carried out in the following two manners.

As shown in FIG. 2, screws 500 (which may also be bolts) and pressure plates 400 may be disposed, a connecting hole is provided at the center of each of the airtight sheets 300, a screw 500 hole (which may be a threaded hole) is provided at the center of each of the upper closure plate 100 and the lower closure plate 200, and each of the screws 500 sequentially passes through the respective pressure plate 400 and the connecting hole and is screwed tight and fixed into the screw 500 hole.

Alternatively, screw nuts and pressure plates 400 may be disposed, a connecting hole is provided at the center of each of the airtight sheets 300, a stud is disposed at a center of the surface of the upper closure plate 100 away from the lower closure plate and at a center of a surface of the lower closure plate 200 away from the upper closure plate, and each of the studs sequentially passes through the connecting hole and the respective pressure plate 400 and is screwed tight and fixed with the screw nut.

Here, each of the pressure plates 400 is configured to increase a contact area with the airtight sheets 300, so that the airtight sheets 300 are further attached and fixed to the upper closure plate 100 and the lower closure plate 200.

Further, in the present embodiment, each of the upper closure plate 100 and the lower closure plate 200 is further provided thereon with an air outlet hole for slow-descending 102, and each of the air outlet holes for slow-descending 102 is remote from the airtight sheets 300.

Each of the air outlet holes for slow-descending 102 has a very small hole diameter, such that when the segmental rails 600 are retracted, the air in the cavity between the upper closure plate 100 of one closure cover and the lower closure plate 200 of another adjacent closure cover can be slowly discharged from the air outlet holes for slow-descending 102, and the retraction efficiency of the extension ladder is accelerated on the premise of ensuring that the speed at which the segmental rails 600 are slowly retracted does not cause a safety hazard to the user.

Further, in order to ensure the sealing between each of the upper closure plate 100 and the lower closure plate 200 and the segmental rails 600, as shown in FIG. 2, sealing rings 700 are further included in the present embodiment, a side edge of each of the upper closure plate 100 and the lower closure plate 200 is provided with a sealing ring groove 103, and the sealing rings 700 are fixed in the sealing ring grooves 103.

Further, the connector 800 provided in the present embodiment is a cylindrical supporting column having two ends fixed at the central positions of the upper closure plate 100 and the lower closure plate 200, respectively, and the supporting column, the upper closure plate 100, and the lower closure plate 200 are provided to be formed integrally; and a cavity communicating with the outside is formed between the upper closure plate 100 and the lower closure plate 200 while ensuring a stable overall structure of the closure cover.

Alternatively, as shown in FIG. 2, the connector 800 may also be provided as a reinforcing rib disposed radially. The reinforcing rib has a larger contact area with the upper closure plate 100 and the lower closure plate 200, thereby further ensuring the stability of the closure cover as a whole.

Second Embodiment

As shown in FIG. 3 and FIG. 4, the present embodiment provides an extension ladder comprising two ladder rails and a plurality of transverse ladder steps; wherein each of the ladder rails comprises a plurality of segmental rails 600 and a plurality of the closure covers described above; the segmental rails 600 on the two ladder rails are in one-to-one correspondence, and two ends of each of the transverse ladder steps are respectively fixed to one ends of the two corresponding segmental rails 600 which are in one-to-one correspondence, with the one ends fixed to the upper closure plates 100.

With the use of the closure covers described above in the extension ladder according to the present embodiment, it is ensured that the extension ladder does not cause a safety hazard such as a pinching injury or a crush injury to the user due to an excessively fast speed during retraction, and the extension ladder is also stretched easily and effortlessly during extension.

It is worth mentioning that the extension ladder may also consist of one ladder rail and a plurality of transverse ladder steps, as long as it is ensured that the connections between the transverse ladder steps and the ladder rail can stably bear the weight of the user.

Further, in the present embodiment, an air-bleed hole 601 is provided at an intermediate position of each of the segmental rails 600.

Each of the air-bleed holes 601 allows the cavity between the upper closure plate 100 of one closure cover and the lower closure plate 200 of another adjacent closure cover to communicate with the outside. While the segmental rails 600 are being retracted and pressed downward, when the lower closure plate 200 of the upper one closure cover does not pass the air-bleed hole 601, the cavity does not exert a jacking force on the upper segmental rail 600, and the segmental rail 600 is accelerated downward; and when the lower closure plate 200 of the upper one closure cover passes the air-bleed hole 601, the air in the cavity cannot be discharged, and the internal pressure is increased, and thus a jacking force is exerted on the upper segmental rail 600, and the descending speed of the segmental rail 600 is slowed down, whereby the slow descending function of the extension ladder is accomplished.

The provision of the air-bleed holes 601 further increases the retraction efficiency of the extension ladder to meet the needs of the user, while ensuring that the slow descending function of the extension ladder is unchanged.

In addition, the air-bleed holes 601 may also be located at other positions of each of the segmental rails 600 by changing and adjusting the number and diameter of the air-bleed holes 601 while ensuring that the slow descending function of the extension ladder is unchanged.

Further, in order to fix the closure covers to one end of each of the segmental rails 600, as shown in FIG. 2 and FIG. 4, in the present embodiment, at least one elastic fastener 201 is disposed on a surface of each of the lower closure plates 200 facing the upper closure plates 100 respectively, at least one snapping groove 602 is disposed at a corresponding position of the inner wall of each of the segmental rails 600, and the elastic fasteners 201 can be snap-fitted in the snapping grooves 602.

Specifically, the upper closure plate 100 of each of the closure covers is controlled to slide toward the inner cavity of the each of the segmental rails 600 and at the same time drive the elastic fasteners 201 to enter the inner cavity until a protrusion at the top end of each of the elastic fasteners 201 is engaged in the snapping groove 602 in the inner wall of each of the segmental rails 600, whereby the fixing of the closure covers are accomplished.

Alternatively, the closure covers and the segmental rails 600 may also be fixed by insertion pins. Specifically, fixing pins are further included in the present embodiment, the connectors 800 and the segmental rails 600 are provided with pin holes, and each of the upper closure plates 100 is fixedly connected with each of the segmental rails 600 by passing the fixing pins through the two pin holes, respectively.

It is worth noting that, during assembling of the extension ladder, after each of the lower closure plates 200 is inserted into a next segmental rail 600, the insertion end of each of the segmental rails 600 may be provided with a stop ring for preventing the lower closure plate 200 of each of the closure covers from being removed from the segmental rails 600.

Finally, it should be noted that the above embodiments are merely intended to illustrate, but not to limit, the technical solutions of the present disclosure. Although the present disclosure has been described in detail with reference to the foregoing embodiments, it should be understood by those of ordinary skill in the art that the technical solutions recited in the foregoing embodiments may be modified, or some or all of the technical features thereof may be substituted with equivalents; and all these modifications or substitutions will not cause the spirit of the corresponding technical solutions to depart from the scope of the technical solutions of the embodiments of the present disclosure.

The invention claimed is:

1. A closure cover, comprising an upper closure plate, a lower closure plate, and two airtight sheets, wherein the upper closure plate and the lower closure plate are fixedly connected by a connector, the upper closure plate and the lower closure plate are each provided with ventilation holes, the airtight sheets are fixed to a surface of the upper closure plate facing away from the lower closure plate and to a surface of the lower closure plate facing away from the upper closure plate, respectively, and each of the airtight sheets is capable of controlling respectively closing and opening of the ventilation holes.

2. The closure cover according to claim 1, wherein the closure cover further comprises screws and pressure plates, each of the airtight sheets is a circular elastic sheet, a connecting hole is provided at a center of each of the airtight sheets, a screw hole is provided at a center of each of the upper closure plate and the lower closure plate, and each of the screws sequentially passes through the respective pressure plate and the connecting hole and is screwed tight and fixed into the screw hole.

3. The closure cover according to claim 1, wherein the closure cover further comprises screw nuts and pressure plates, each of the airtight sheets is a circular elastic sheet, a connecting hole is provided at a center of each of the airtight sheets, a stud is disposed at a center of a surface of the upper closure plate facing away from the lower closure plate and at a center of a surface of the lower closure plate facing away from the upper closure plate, respectively, and each of the studs sequentially passes through the connecting hole and the respective pressure plate and is screwed tight and fixed with the screw nut.

4. The closure cover according to claim 2, wherein each of the upper closure plate and the lower closure plate is provided with an air outlet hole for slow-descending, and each of the air outlet holes for slow-descending is remote from the airtight sheets.

5. The closure cover according to claim 1, wherein the closure cover further comprises sealing rings, a side edge of each of the upper closure plate and the lower closure plate is provided with a sealing ring groove, and the sealing rings are fixed in the sealing ring grooves, respectively.

6. The closure cover according to claim 3, wherein each of the upper closure plate and the lower closure plate is provided with an air outlet hole for slow-descending, and each of the air outlet holes for slow-descending is remote from the airtight sheets.

* * * * *